US006089495A

United States Patent [19]

Cramer et al.

[11] Patent Number: 6,089,495

[45] Date of Patent: Jul. 18, 2000

[54] WINDING DEVICE AND METHOD FOR A REEL CUTTER

[75] Inventors: Dirk Cramer, Duisburg; Jens Krüger, Heidenheim, both of Germany

[73] Assignee: Voith Sulzer Papiertechnik Patent GmbH, Heidenheim, Germany

[21] Appl. No.: 09/204,499

[22] Filed: Dec. 4, 1998

[30] Foreign Application Priority Data

Dec. 5, 1997 [DE] Germany ..... 197 53 871

[51] Int. Cl.[7] ..... B65H 19/28; B65H 19/30

[52] U.S. Cl. ..... 242/530.4; 242/533.2; 242/532.3

[58] Field of Search ..... 242/530.4, 530.1, 242/530.3, 533.2, 533.7, 532.3

[56] References Cited

U.S. PATENT DOCUMENTS

| | | | |
|---|---|---|---|
| 4,749,140 | 6/1988 | Ruff | 242/533.2 |
| 4,909,454 | 3/1990 | Welp et al. . | |
| 4,932,599 | 6/1990 | Doerfel . | |
| 4,951,900 | 8/1990 | Goerner | 242/530.4 |
| 5,000,395 | 3/1991 | Welp et al. . | |
| 5,356,087 | 10/1994 | Smith et al. | 242/530.4 |
| 5,636,810 | 6/1997 | Dorfel et al. | 242/530.4 |
| 5,795,432 | 8/1998 | Urban | 242/532.3 |

FOREIGN PATENT DOCUMENTS

| | | |
|---|---|---|
| 258533 | 3/1988 | European Pat. Off. . |
| 3540490 | 3/1987 | Germany . |
| 3629024 | 3/1988 | Germany . |
| 3737503 | 5/1989 | Germany . |
| 3744961 | 5/1989 | Germany . |
| 3800702 | 8/1989 | Germany . |
| 91/18815 | 12/1991 | WIPO . |
| 97/08088 | 3/1997 | WIPO . |

*Primary Examiner*—John M. Jillions
*Attorney, Agent, or Firm*—Greenblum & Bernstein, P.L.C.

[57] ABSTRACT

Winding device and method for a reel cutter that includes a feed path that is adapted to support a plurality of reel cores, and a plurality of trestles that are adapted for movement substantially parallel to the feed path. Each of the plurality of trestles are coupled to a bearing spindle. A plurality of gripper devices are provided that are adapted for movement substantially parallel to the feed path and that include at least one grip head having a portion adapted for grasping one of the plurality of reel cores. The at least one grip head is moveable between the feed path to the bearing spindle. The method includes gripping one of the reel cores in the feed path with the gripping device of the at least one grip head, moving the one reel core to the bearing spindles, and coupling the bearing spindles to the one reel core.

26 Claims, 2 Drawing Sheets

FIG. 2A
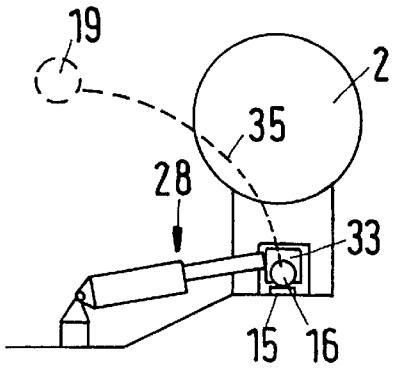
FIG. 2B
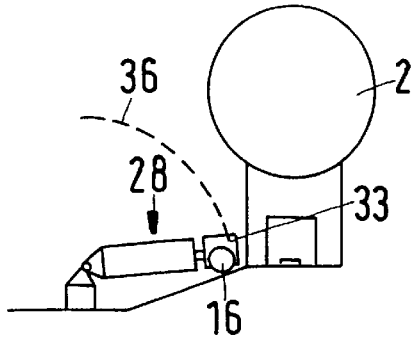
FIG. 2C
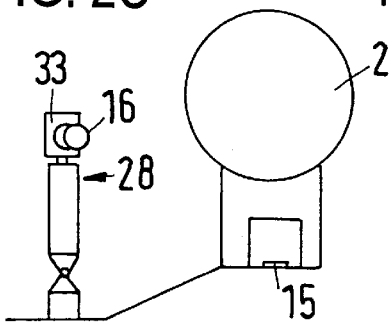
FIG. 2D
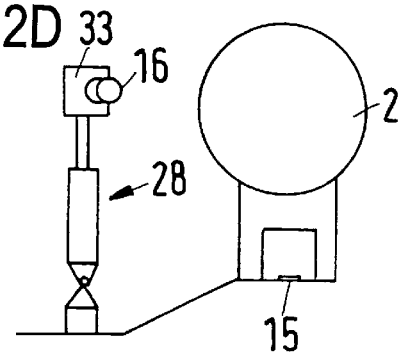
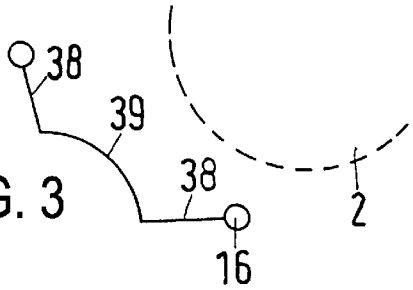
FIG. 3
FIG. 4
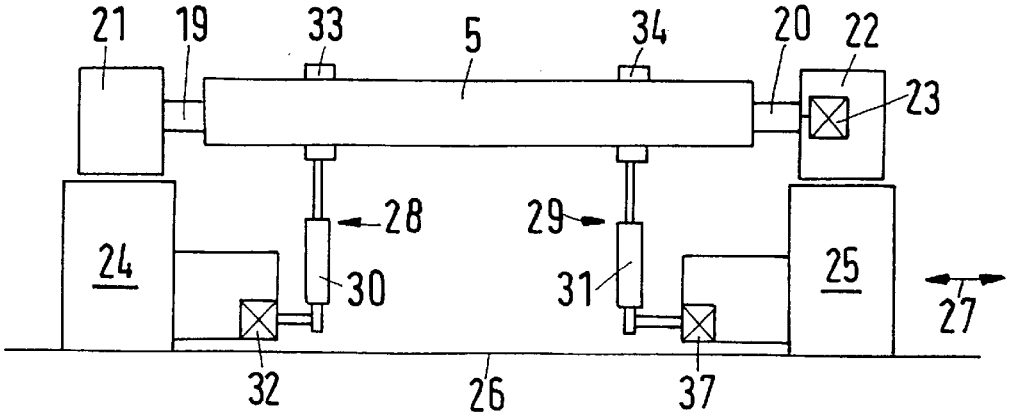

WINDING DEVICE AND METHOD FOR A REEL CUTTER

CROSS-REFERENCE TO RELATED APPLICATIONS

The present application claims priority under 35 U.S.C. §119 of German Patent Application No. 197 53 871.1, filed on Dec. 5, 1997, the disclosure of which is expressly incorporated by reference herein in its entirety.

BACKGROUND OF THE INVENTION

1. Field of the Invention

The present invention relates to a winding device for a reel cutter having a supporting roller arrangement, a plurality of winding positions arranged into at least two winding position groups, and at least one pair of axially displaceable trestles. Each of the axially displaceable trestles have a bearing spindle for keeping a winding roll centered. The winding device also includes a feed path for reel cores running substantially in an axial direction and a device for distributing reel cores to the individual winding positions.

2. Discussion of Background Information

WO 97/08088 discloses a winding device similar in general to the above-noted device, in which the feed path includes two rails, each of which is attached to a support. The height of the supports can be adjusted independently of each other. Individual reel cores of a set are displaced one after the other into a respective axial position coordinated with a winding position. From these positions, by raising one or the other rail, the rolls are moved to the side into holding devices from which they cannot roll back out even when the corresponding support is raised once again. This makes it possible to isolate the roller cores, i.e., to distribute them to the individual winding position groups. The supports with all the reel cores on them are then raised along a predetermined, essentially straight movement path, so that the individual bearing spindles in each winding position can be inserted laterally into the reel cores.

DE 38 00 702 C2 discloses another arrangement, in which the reel cores are already coordinated with the individual winding position groups upon being inserted into the winding device. A track arrangement is provided for each winding position group. Both track arrangements are so closely adjacent to each other that the individual reel cores overlap. Therefore, only a single sliding motion is needed to push all the reel cores of a set into the winding device. However, sorting of the reel cores, i.e., distribution to the tracks, is required prior to insertion.

DE 37 37 503 C2 and DE 37 44 961 C2 disclose another arrangement, in which the feed path is positioned above a supporting roller arrangement. The feed path includes a tube closed at the bottom that can be swung open. Below the tube, catch arms having upward-pointing tips are provided that penetrate through a center plane below the tube. With the aid of the catch arms, the individual reel cores are diverted to one side or the other of the center plane. The catch arms can also be swung away downward. The reel cores then fall onto a roof-like distributing device, in order to roll to their winding positions. However, this winding device does without the bearing spindles on the axially displaceable trestles.

Thus, it takes a relatively long time until all reel cores of a set are inserted into the winding device, and an increased level of care is required during insertion. Accordingly, isolation is handled by the catch arms, which are distributed evenly across the axial length. Thus the freedom to design the cutting plan is limited to certain dimensions of reel cores.

SUMMARY OF THE INVENTION

The present invention provides a device that supplies reel cores to a winding device with a high degree of automation, so that the cutting plan remains flexible.

The present invention provides a winding device of the type generally discussed above, in which at least one gripper is provided in each winding position that can be jointly moved with a trestle in an axial direction and that has a grip head with a gripping device for grasping and holding a reel core, which is movable from the feed path to the bearing spindle.

Various advantages over the prior art are provided with an arrangement of the present invention. For example, the gripper can be moved with a trestle in an axial direction. This ensures that the gripper is always in a position to grasp a reel core and to transport the reel core to a winding position. A material web may be spooled onto the reel core to form a winding roll in the respective winding position. In accordance with the features of the present invention, it is no longer necessary to move all reel cores together. Rather, each reel core can be handled individually. However, the present invention does not preclude the possibility of moving several reel cores at the same time from the feed path into the winding position. Further, all reel cores may be inserted jointly into the winding device. It is noted that only the sequence and the axial direction must coincide with the winding positions, which saves a significant amount of time. Insertion can also be performed with less vigilance, i.e., so that insertion may be automated with more simple means, or may be performed by unskilled operators. By moving the reel core from the feed path to the bearing spindle with the aid of the head, the movement path of the reel core may be predetermined. No chance variations can occur, as may arise when, e.g., the reel core is moved with excessive momentum. Thus, the entire movement of the reel core is kept under control, so that the winding device can operate with a high degree of reliability even when the reel is changed, i.e., when a new reel core is fed into the individual winding position.

In a preferred arrangement, the gripper may be attached to its trestle. This facilitates the controlled movement of the gripper together with the trestle. As soon as the trestle is moved, which is necessary when the cutting plan is changed, the gripper may be moved along with it. In this manner, it is ensured, through very simple means, that the gripper is present in every winding position.

In accordance with the exemplary embodiment, it may be preferable that each trestle has a gripper, so as to further facilitate handling. It may also be preferable that each reel core may be grasped at two points. These two points may be adjacent to the ends of the reel core because the gripper is attached to the trestle. In this manner, a very stable bearing may be produced, and the reel core may be substantially prevented from tilting during transport. At the same time, the reel core may be held where the bearing spindles are supposed to be inserted into it, i.e., on the end. In this way, even with fairly unstable reel cores, very accurate coordination may be possible between the position of the reel core and the position of the bearing spindle.

In this regard, it may be particularly preferable that the two grippers are arranged on the sides of the trestle positioned to face each other. In this way, the grippers may be automatically positioned within an axial length in which the reel core is also located. Additional measures for axially aligning the gripper with respect to the reel core may no longer be necessary.

Preferably, the feed path may be arranged below the supporting roller arrangement and the bearing spindles may be arranged alongside the supporting roller arrangement. This arrangement may simplify construction of the winding device and may facilitate handling during feeding. Thus, it may no longer be necessary to employ a tube to be opened toward the bottom. Further, the feed path can be kept rigid without requiring additional movements, i.e., it must simply support the reel cores from below and provide the possibility of access from another side, e.g., from the top or from the side, or from the top and from the side. For the grippers, then, only one movement may be necessary from the feed path to the bearing spindles, which may be realized in a relatively simple manner.

In another preferred arrangement, the head may travel along a nonlinear movement path outside around the supporting roller arrangement. In this regard, it is noted that movements that occur exclusively along a straight line or a circular line would be linear movements. Thus, a collision between the supporting roller arrangement and the head of the gripper may be substantially avoided. Further, the user may be less limited in terms of selecting the size of the supporting roller arrangement, e.g., if the supporting roller arrangement is formed by a single supporting roller, then it can have a relatively large diameter to improve rigidity. Essentially it is only necessary that a certain amount of marginal area for movement remain outside around the supporting roller arrangement, through which the movement path of the head runs. The reel cores can then be guided outside around the supporting roller arrangement.

In another preferred arrangement, the movement path may be created by two degrees of motion of the head. Accordingly, only two drives may be necessary for the head, thereby simplifying the control of the head along the movement path.

Preferably the movement path may include a traveling portion and a swiveling portion. Thus, the movement may include a linear component that can be realized by a linear drive, e.g., a piston-cylinder arrangement, and a swiveling component that can be created via swiveling of the piston-cylinder arrangement by an appropriately designed motor.

Preferably the traveling portion may be decoupled in time from the swiveling portion. Thus, the movement path includes clearly separated sections that occur chronologically one after the other. Thus, it may only be necessary to have one drive in operation at a time, which further simplifies the control. Accordingly, the control device can be designed in a relatively inexpensive manner.

Advantageously, the traveling portion may include two parts divided in time, i.e., before and after the swiveling portion. Thus, the head may grasp a reel core, may be inserted, swiveled, and may then be removed once again. This relatively simple movement is sufficient to guide the reel core without collision outside around the supporting roller arrangement.

In another advantageous arrangement, an adhesive application device may be positioned at a start of the feed path to provide adhesive for the individual reel cores at a predetermined circumferential section, depending on the winding position groups provided. In this manner, the fact that individual reel cores in the individual winding position groups may have a different orientation relative to the supporting roller arrangement can be addressed. If the supplied material webs to be spooled are to be attached to the reel cores without additional handling, then an appropriate adhesive surface must be provided on the reel cores. Then it may only be necessary to simply press the material web onto the reel cores to begin the winding procedure. If this adhesive surface is created as the reel core is inserted into the winding device, subsequent handling is made easier.

Accordingly, the present invention is directed to a winding device for a reel cutter that includes a supporting roller arrangement, at least two winding position groups, a plurality of winding positions provided within the at least two winding position groups, and trestles mounted for axial movement relative to the supporting roller. Each trestle includes a bearing spindle that is adapted for centrally holding a winding roll. The winding device also includes a feed path extending substantially axially, with respect to the supporting roller arrangement, that is adapted to support reel cores, and a distributing device that is adapted for distributing reel cores to individual winding positions that includes at least one gripper that is adapted for axial movement with one of the trestles and that has of at least one grip head with a gripping device that is adapted for grasping and holding the reel core. The at least one grip head is adapted for movement from the feed path to the bearing spindle.

The present invention may also be directed to a winding device for a reel cutter that includes a feed path that is adapted to support a plurality of reel cores, and a plurality of trestles that are adapted for movement substantially parallel to the feed path. Each of the plurality of trestles are coupled to a bearing spindle. A plurality of gripper devices are provided that are adapted for movement substantially parallel to the feed path and that include at least one grip head having a portion adapted for grasping one of the plurality of reel cores. The at least one grip head is moveable between the feed path to the bearing spindle.

In accordance with another feature of the present invention, the plurality of gripper devices may include a device for moving the at least one grip head in a substantially straight line. Further, the device for moving may include a cylinder-piston device.

In accordance with another feature of the present invention, the plurality of gripper devices may include a device for moving the at least one grip head in a substantially circular path.

In accordance with another feature of the present invention, the plurality of gripper devices may include a device for moving the at least one grip head in a substantially straight line toward and away from the feed path and in a substantially straight line toward and away from bearing spindles, and a device for moving the at least one grip head in a substantially circular path from the substantially straight line toward and away from the feed path to the substantially straight line toward and away from the bearing spindles. Further, the device for moving the at least one grip head in a substantially straight path and device for moving the at least one grip head in a substantially circular path includes a cylinder-piston device having a base portion coupled to a rotational drive.

In accordance with another feature of the present invention, supports may be coupled to the trestles for movement substantially perpendicular to the feed path. Further, the bearing spindles may be coupled to the supports.

The present invention may also be directed to a method for spooling winding rolls in a winding device that includes a feed path extending substantially axially, with respect to a supporting roller arrangement, supporting reel cores, bearing spindles for centrally receiving the reel cores, and a distributing device including at least one gripper having at least one grip head with gripping device. The method includes gripping one of the reel cores in the feed path with the gripping device of the at least one grip head, moving the one reel core to the bearing spindles, and coupling the bearing spindles to the one reel core.

In accordance with another feature of the present invention, the method further includes, prior to gripping the one reel core, extending the at least one grip head in a direction toward the one reel core in the feed path to be gripped, and, after gripping the one reel core, moving the one reel core in a substantially circular path.

In accordance with another feature of the present invention, after gripping the one reel core, the method includes retracting the at least one grip head and the one roll from the feed path, and moving the one reel core in a substantially circular path.

In accordance with another feature of the present invention, after gripping the one reel core, the method further includes moving the one reel core in a substantially circular path, and extending the at least one grip head and the one roll to a substantially coaxial position with the bearing spindle.

In accordance with another feature of the present invention, before gripping the one reel core, the method further includes moving the at least one gripper in a direction substantially parallel to the feed path, and aligning the at least one grip head with an axial end of the one reel core.

In accordance with another feature of the present invention, after the coupling of the bearing spindles to the one reel core, the method includes rotating the reel core to form a winding roll, and moving the reel core radially away from the support roller arrangement as a diameter of the winding roll increases.

In accordance with another feature of the present invention, prior to gripping the one reel core, the method including applying an adhesive to a circumferential portion of the one reel core in accordance with a winding position group in which the one reel core is to be positioned.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein:

FIGS. 2*a*, 2*b*, 2*c*, and 2*d* illustrate various positions of a gripper during a transfer of a reel core;

FIG. 3 illustrates a movement path of the reel core; and

FIG. 4 illustrates a schematic side view of a winding position.

DETAILED DESCRIPTION OF THE PRESENT INVENTION

Figure 1:
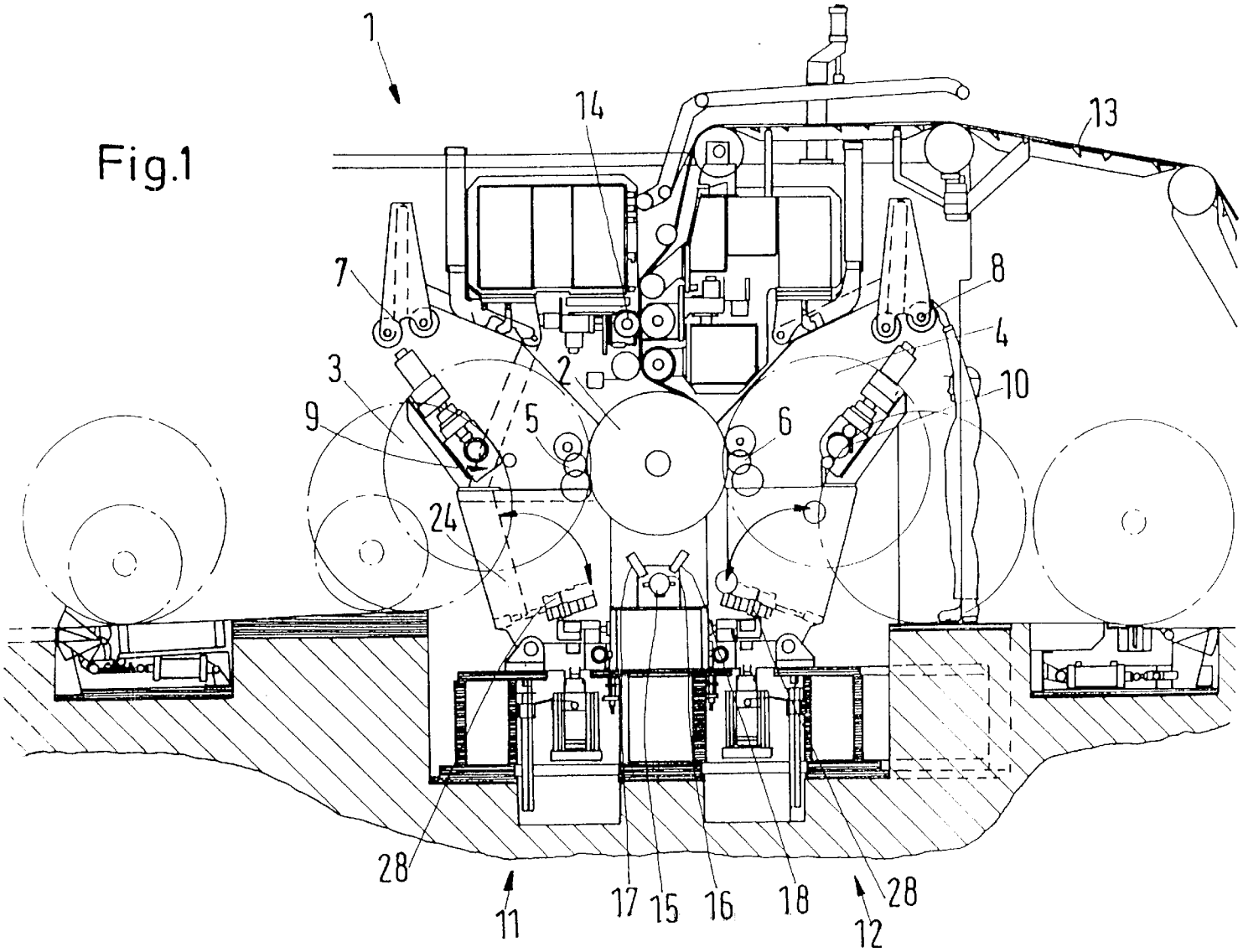
FIG. 1 illustrates a schematic front view of a winding device of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A winding device 1 for a reel cutter as illustrated in FIG. 1 includes a supporting roller 2. During winding, opposite sides of supporting roller 2 may be positioned adjacent to winding rolls 3 and 4. Winding rolls 3 and 4 may be formed by material web 13 being spooled onto reel cores 5 and 6, which may be winding tubes made of, e.g., cardboard. At a start of the winding process, reel cores 5 and 6 may be pressed against supporting roller 2, e.g., via a rider (or load) roller arrangement 7 and 8. Otherwise, reel cores 5 and 6 may be centrally driven, e.g., by a drive arrangement 9 and 10, shown schematically only.

Winding rolls 3 and 4 may be positioned in one of two different winding position groups 11 and 12. Each winding position group 11 and 12 may include one or a plurality of winding rolls 3 and 4 to be spooled simultaneously. Individual winding rolls 3 or 4 within a same winding group 11 or 12 may be arranged so that a particular axial distance is provided between adjacent winding rolls. In this manner, drive arrangements 9 and 10 may be axially inserted into reel cores 5 and 6. Winding rolls 3 in winding position group 11 may be arranged within the axial gaps between winding rolls 4 of winding position group 12, and vice versa. Thus, the width of the axial gaps corresponds to the width, i.e., the axial length, of winding rolls 3 and 4 arranged in the other winding position group.

Material web 13, which is to be spooled, may be guided across or through a cutting device 14 so as to subdivide or cut material web 13 in a longitudinal direction. In this manner, a plurality of partial webs are formed.

Below supporting roller 2, which may include a plurality of supporting rollers, a feed path 15 for reel cores 16 may be positioned. While winding rolls 3 and 4 are being spooled, a new set of reel cores 16 may be, e.g., successively introduced (i.e., one after the other) in an axial direction at one time, e.g., via a single thrust. Prior to introducing or inserting the individual reel cores, the reel cores may be arranged in an appropriate order so that the axial lengths of the reel cores will correspond with the partial web to be spooled. Upon insertion, a specific circumferential section of reel cores 16 can be made adhesive via adhesive application devices 17 and 18. In this manner, if the winding is performed such that reel cores 16 are to be inserted into only one winding position group 11 or 12 at a time, then it may only be necessary to utilize one of the two illustrated adhesive application devices 17 and 18 at a time. Thus, the specific adhesive application device 17 or 18 to be utilized depends upon whether winding position group 11 or 12 is the next winding position group to receive individual reel cores 16 to be spooled.

As illustrated in FIG. 4, a reel core 5 may be centrally held for winding between two bearing spindles 19 and 20. Bearing spindles 19 and 20 may be positioned on supports 21 and 22 for rotation, and at least one of the two supports, e.g., support 22 as shown in the exemplary embodiment, is coupled to a rotary drive unit 23 for driving bearing spindle 20, which may be, e.g., a tensioning spindle. Supports 21 and 22 may be supported on trestles 24 and 25 so as to facilitate movement either toward or away from supporting roller 2, which would be substantially perpendicular to the axis of reel core 5 and/or, in the exemplary illustration, substantially perpendicular to the drawing plane of FIG. 4. By this movement, it is possible to accommodate an increasing roll diameter during spooling. Trestles 24 and 25 may be displaceable on a foundation 26 in a direction indicated by double-headed arrow 27. Through this displacement, e.g., shifting or moving, of trestles 24 and 25, which may be substantially parallel to the winding axis, modifications made to the cutting plan may be easily adjusted for to enable, e.g., spooling varying reel widths or spooling reels at different positions.

A gripper 28 and 29 may be coupled to each trestle 24 and 25. In this manner, gripper 28 and 29 may be displaceable along with respective trestle 24 and 25. Each gripper 28 and 29 may include, e.g., a piston-cylinder device 30 and 31, a lower end of which may be coupled to trestle 24 and 25 via a rotary drive 32 and 37. A head 33 and 34, with which gripper 28 and 29 can grasp and hold reel core 5, may be positioned at an upper end of piston-cylinder device 30 and 31. The grasping of reel core 5 may be performed, e.g., by clamping reel core 5. However, it may also be possible to utilize a suction device (not illustrated in any further detail) in heads 33 and 34 to facilitate for suctioning reel core 5 into heads 33 and 34.

Via grippers 28 and 29, it is possible to transport reel core 5 (or 16), which is positioned in a respective winding position within feed path 15, into a position so that bearing spindles 19 and 20, which may also be tensioning spindles, may be inserted into the transported reel core 5. Since grippers 28 and 29 are movably positioned on movable trestles 24 and 25, grippers 28 and 29 may be automatically located in an area of the axial ends of reel core 5. In this manner, reel core 5 may be supported at its axial ends and bearing spindles 19 and 20 can be inserted into reel core 5 with a high degree of reliability.

FIGS. 2*a*–2*d* schematically illustrate an exemplary route that reel core 16 may take from feed path 15 to reach a corresponding bearing spindle 19 (shown in dashed lines).

FIG. 2*a* schematically depicts a start of the transport procedure. Head 33 of gripper 28 may grasp reel core 16 as it lies on feed path 15, i.e., below supporting roller 2. As indicated by dashed line 35, a direct swiveling motion of gripper 28 to bearing spindle 19 would not be possible because head 33 would interfere or collide with supporting roller 2 along movement path 35.

Accordingly, head 33 may be retracted while holding reel core 16, as depicted in FIG. 2*b*, so as to reduce the length of gripper 28. As indicated by dashed line 36, a swiveling movement by gripper 28 in its reduced length would enable head 33 to move past supporting roller 2 along movement path 36. Thus, once head 33 is moved along movement path 36, head 33 and reel core 16, may be in a position such as that illustrated in FIG. 2*c*. However, in order for head 33 to locate reel core 16 in a desired position, i.e., opposite bearing spindle 19, head 33 may be extended so as to increase the length of gripper 28, thereby lifting reel core 16, as shown in FIG. 2*d*.

The movement path of head 33 may be even more schematically represented in FIG. 3. The movement path may include two traveling portions 38 connected to each other by a swiveling portion 39. Supporting roller 2 is schematically shown in dashed lines to indicate that reel core 16 may be moved along outside past the supporting roller 2 without interfering with support roller 2. Thus, the movement path may be realized by two degrees of freedom, i.e., a linear movement (traveling portions 38) that may be performed, e.g., via piston-cylinder devices 30 and 31, and a swiveling movement (swiveling portion 39) that may be performed by, e.g., rotary drive 32 and 37. Because the individual movement portions successively occur, i.e., one after the other chronologically, the control can be kept very simple.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A winding device for a reel cutter comprising:

a supporting roller arrangement;

at least two winding position groups;

a plurality of winding positions provided within the at least two winding position groups;

trestles mounted for axial movement relative to the supporting roller, and each trestle includes a bearing spindle adapted for centrally holding a winding roll;

a feed path extending Substantially axially, with respect to the supporting roller arrangement, adapted to support reel cores; and a distributing device adapted for distributing reel cores to individual winding positions comprising at least one gripper adapted for axial movement with one of the trestles having at least one grip head with a gripping device adapted for grasping and holding the reel core, wherein the at least one grip head is adapted for movement from the feed path to the bearing spindle, and wherein the at least one grip head is guidable along a straight movement path and a curved movement path outside a circumference of the supporting roller arrangement.

2. The winding device in accordance with claim 1, the at least one gripper being coupled to the one of the trestles.

3. The winding device in accordance with claim 1, each trestle being coupled to one of the at least one gripper.

4. The winding device in accordance with claim 3, the trestles being arranged into at least one pair of trestles; and the grippers being arranged on sides of the trestles that face each other.

5. The winding device in accordance with claim 1, the movement path includes two degrees of freedom of movement for the at least one grip head.

6. The winding device in accordance with claim 5, the movement path includes a traveling portion in which the at least one grip head is movable in a substantially straight line and a swiveling portion in which the at least one grip head is movable in a substantially circular path.

7. The winding device in accordance with claim 6, wherein the traveling portion is sequentially separate from the swiveling portion.

8. The winding device in accordance with claim 1, further comprising an adhesive application device arranged adjacent to the feed path, wherein the adhesive application device applies adhesive to a predetermined circumferential section of reel cores, the predetermined circumferential section depending on the winding position group into which the reel core is to be distributed.

9. The winding device in accordance with claim 1, wherein the straight movement path is performed at least one of before and after the curved movement path.

10. A winding device for a reel cutter comprising:

a supporting roller arrangement;

at least two winding position groups;

a plurality of winding positions provided within the at least two winding position groups;

trestles mounted for axial movement relative to the supporting rollers and each trestle includes a bearing spindle adapted for centrally holding a winding roll;

a feed path extending substantially axially with respect to the supporting roller arrangement, adapted to support reel cores;

a distributing device adapted for distributing reel cores to individual winding positions comprising at least one gripper adapted for axial movement with one of the trestles having at least one grip head with a gripping device adapted for grasping and holding the reel core, wherein the at least one grip head is adapted for movement from the feed path to the bearing spindle;

the feed path being positioned below the supporting roller arrangement; and the bearing spindles being positioned alongside the supporting roller arrangement.

11. A winding device for a reel cutter comprising:

a supporting roller arrangement;

at least two winding position groups;

a plurality of winding positions provided within the at least two winding position groups;

trestles mounted for axial movement relative to the supporting roller and each trestle includes a bearing spindle adapted for centrally holding a winding roll;

a feed path extending substantially axially with respect to the supporting roller arrangement, adapted to support reel cores; and a distributing device adapted for distributing reel cores to individual winding positions comprising at least one gripper adapted for axial movement with one of the trestles having at least one grip head with a gripping device adapted for grasping and holding the reel core, wherein the at least one grip head is adapted for movement from the feed path to the bearing spindle, wherein the at least one grip head is guidable along a non-linear movement path outside a circumference of the supporting roller arrangement;

the movement path includes two degrees of freedom of movement for the at least one grip head and includes a traveling portion in which the at least one grip head is movable in a substantially straight line and a swiveling portion in which the at least one grip head is movable in a substantially circular path; and the traveling portion includes two sections sequentially arranged before and after the swiveling portion.

12. A winding device for a reel cutter comprising:

a feed path adapted to support a plurality of reel cores;

a plurality of trestles adapted for movement substantially parallel to the feed path, and each of the plurality of trestles being coupled to a bearing spindle;

a plurality of gripper devices adapted for movement substantially parallel to the feed path comprising at least one grip head having a portion adapted for grasping one of the plurality of reel cores; and the at least one grip head being moveable along a straight path and a curved path between the feed path to the bearing spindle.

13. The winding device in accordance with claim 12, the plurality of gripper devices comprising a device for moving the at least one grip head in a substantially straight line.

14. The winding device in accordance with claim 13, the device for moving comprising a cylinder-piston device.

15. The winding device in accordance with claim 12, the plurality of gripper devices comprising a device for moving the at least one grip head in a substantially circular path.

16. The winding device in accordance with claim 12, further comprising supports coupled to the trestles for movement substantially perpendicular to the feed path.

17. The winding device in accordance with claim 16, the bearing spindles being coupled to the supports.

18. A winding device for a reel cutter comprising:

a feed path adapted to support a plurality of reel cores;

a plurality of trestles adapted for movement substantially parallel to the feed path, and each of the plurality of trestles being coupled to a bearing spindle;

a plurality of gripper devices adapted for movement substantially parallel to the feed path comprising at least one grip head having a portion adapted for grasping one of the plurality of reel cores;

the at least one grip head being moveable between the feed path to the bearing spindle; and the plurality of gripper devices comprising:

a device for moving the at least one grip head in a substantially straight line toward and away from the feed path and in a substantially straight line toward and away from bearing spindles; and a device for moving the at least one grip head in a substantially circular path from the substantially straight line toward and away from the feed path to the substantially straight line toward and away from the bearing spindles.

19. The winding device in accordance with claim 18, the device for moving the at least one grip head in a substantially straight path and device for moving the at least one grip head in a substantially circular path comprising a cylinder-piston device having a base portion coupled to a rotational drive.

20. A method for spooling winding rolls in a winding device that includes a feed path extending substantially axially, with respect to a supporting roller arrangement, supporting reel cores, bearing spindles for centrally receiving the reel cores, and a distributing device including at least one gripper having at least one grip head with gripping device, the method including:

gripping one of the reel cores in the feed path with the gripping, device of the at least one grip head;

moving the one reel core along a straight path and a curved path to the bearing spindles; and coupling the bearing spindles to the one reel core.

21. The method in accordance with claim 20, after gripping the one reel core, further comprising:

moving the one reel core in a substantially circular path; and extending the at least one grip head and the one roll to a substantially coaxial position with the bearing spindle.

22. The method in accordance with claim 20, before gripping the one reel core, further comprising:

moving the at least one gripper in a direction substantially parallel to the feed path; and aligning the at least one grip head with an axial end of the one reel core.

23. The method in accordance with claim 20, after the coupling of the bearing spindles to the one reel core, further comprising:

rotating the reel core to form a winding roll; and moving the reel core radially away from the support roller arrangement as a diameter of the winding roll increases.

24. The method in accordance with claim 20, prior to gripping the one reel core, further comprising:

applying an adhesive to a circumferential portion of the one reel core in accordance with a winding position group in which the one reel core is to be positioned.

25. A method for spooling winding rolls in a winding device that includes a feed path extending substantially axially, with respect to a supporting roller arrangement, supporting reel cores, bearing spindles for centrally receiving the reel cores, and a distributing device including at least one gripper having at least one grip head with gripping device, the method including:

gripping one of the reel cores in the feed path with the gripping device of the at least one grip head;

moving the one reel core to the bearing spindles;

coupling the bearing spindles to the one reel core;

prior to gripping the one reel core, extending the at least one grip head in a direction toward the one reel core in the feed path to be gripped; and after gripping the one reel core, moving the one reel core in a substantially circular path.

26. A method for spooling winding rolls in a winding device that includes a feed path extending substantially axially, with respect to a supporting roller arrangement, supporting reel cores, bearing spindles for centrally receiving the reel cores and a distributing device including at least one gripper having at least one grip head with gripping device, the method including:

gripping one of the reel cores in the feed path with the gripping device of the at least one grip head;

moving the one reel core to the bearing spindles;

coupling the bearing spindles to the one reel core;

after gripping the one reel core, retracting the at least one grip head and the one roll from the feed path; and moving the one reel core in a substantially circular path.

* * * * *